US006775882B2

(12) United States Patent
Murphy et al.

(10) Patent No.: US 6,775,882 B2
(45) Date of Patent: Aug. 17, 2004

(54) STICK VACUUM WITH DIRT CUP

(75) Inventors: John S. Murphy, Brookpark, OH (US); Jeffrey M. Kalman, Cleveland Heights, OH (US); David J. Boll, Avon, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 256 days.

(21) Appl. No.: 10/044,060

(22) Filed: Jan. 11, 2002

(65) Prior Publication Data

US 2003/0131441 A1 Jul. 17, 2003

(51) Int. Cl.[7] ..... A47L 9/20; A47L 9/16

(52) U.S. Cl. ..... 15/352; 15/353; 55/337; 55/429; 55/DIG. 3; 55/482; 55/459.1

(58) Field of Search ..... 15/350, 351, 352, 15/353, 331, 334; 55/337, 429, 459.1, 482, 486, DIG. 3

(56) References Cited

U.S. PATENT DOCUMENTS

| | | | | | |
|---|---|---|---|---|---|
| 2,187,164 | A | | 1/1940 | Leathers | |
| 2,564,339 | A | | 8/1951 | Nerheim | |
| 3,321,794 | A | | 5/1967 | Jepson et al. | |
| 4,172,710 | A | | 10/1979 | van der Molen | |
| 4,373,228 | A | | 2/1983 | Dyson | |
| 4,376,322 | A | | 3/1983 | Lockhart et al. | |
| 4,665,582 | A | | 5/1987 | Richmond et al. | |
| 4,960,446 | A | | 10/1990 | Werner et al. | |
| 5,018,240 | A | | 5/1991 | Holman | |
| 5,020,186 | A | | 6/1991 | Lessig, III et al. | |
| 5,107,567 | A | | 4/1992 | Ferrari et al. | |
| 5,230,722 | A | * | 7/1993 | Yonkers | 55/337 |
| 5,307,537 | A | | 5/1994 | Essex et al. | |
| 5,331,715 | A | | 7/1994 | Johnson et al. | |
| 5,337,443 | A | | 8/1994 | Steinberg et al. | |
| 5,713,103 | A | | 2/1998 | Keebler et al. | |
| 5,867,863 | A | * | 2/1999 | McCormick | 15/351 |
| 6,026,540 | A | * | 2/2000 | Wright et al. | 15/347 |
| 6,070,291 | A | | 6/2000 | Bair et al. | |
| 6,108,864 | A | | 8/2000 | Thomas et al. | |
| 6,141,826 | A | | 11/2000 | Conrad et al. | |
| 6,146,434 | A | | 11/2000 | Scalfani et al. | |
| 6,192,550 | B1 | | 2/2001 | Hamada et al. | |
| 6,193,787 | B1 | * | 2/2001 | Dyson et al. | 95/271 |
| 6,245,159 | B1 | * | 6/2001 | Deng | 134/21 |
| 6,436,160 | B1 | * | 8/2002 | Stephens et al. | 55/337 |
| 6,558,453 | B2 | * | 5/2003 | Sepke et al. | 95/268 |
| 6,578,230 | B2 | * | 6/2003 | Park et al. | 15/353 |
| 6,615,444 | B2 | * | 9/2003 | McGilll et al. | 15/352 |
| 6,647,587 | B1 | * | 11/2003 | Ohara et al. | 15/350 |
| 2002/0046438 | A1 | * | 4/2002 | Oh | 15/353 |
| 2002/0133901 | A1 | * | 9/2002 | Ohta et al. | 15/347 |
| 2003/0084536 | A1 | * | 5/2003 | Yung | 15/351 |

FOREIGN PATENT DOCUMENTS

| | | | |
|---|---|---|---|
| GB | 2321181 | * | 7/1998 |
| WO | WO 02/11595 A1 | | 2/2002 |
| WO | WO 02/11596 A1 | | 2/2002 |

* cited by examiner

*Primary Examiner*—Terrence R. Till
(74) *Attorney, Agent, or Firm*—Fay, Sharpe, Fagan, Minnich & McKee, LLP

(57) ABSTRACT

An upright vacuum cleaner includes a floor nozzle having a suction inlet and a handle. A housing has a first portion connected to the floor nozzle, a second portion connected to the handle and defines a cavity and at least one chamber. A dirt cup assembly is releasably connected to the housing and is at least partially received by the cavity. The dirt cup assembly defines a cyclonic airflow chamber and includes a wall. An inlet duct is defined on the dirt cup assembly wall and a filter assembly is removably positioned in the dirt cup assembly. A motor assembly is disposed in the at least one chamber defined by the housing

45 Claims, 14 Drawing Sheets

STICK VACUUM WITH DIRT CUP

FIELD OF THE INVENTION

The present invention relates to vacuum cleaners. More particularly, the present invention relates to bagless stick vacuum cleaners. Even more particularly, the invention relates to a stick vacuum with a dirt cup having improved air flow.

DESCRIPTION OF RELATED ART

Stick vacuum cleaners are known in the art. These vacuum cleaners are typically more lightweight than traditional upright cleaners and lack the driven brush rolls of traditional upright cleaners. The lighter weight and lack of a driven brush roll allows these cleaners to be more easily manipulated by a user on different surfaces and/or a wider variety of surfaces than traditional upright cleaners.

For example, stick vacuum cleaners are often used on non-carpeted floor surfaces where a driven brush roll may damage the floor surface. A stick vacuum cleaner is also often used for surfaces with hard-to-reach areas or elevated surfaces. The lighter weight and more compact design of a stick vacuum compared to a traditional upright vacuum leads to greater maneuverability and ease of lifting.

Stick vacuum cleaners typically operate by drawing in dirt-laden air via suction that is created by a motor driving a fan or impeller. The dirt-laden air is drawn into the unit through a nozzle and passes through a dirt collection device such as a cup. After the air passes through the dirt collection device it is typically drawn through a filter. Examples of these types of cleaners are provided in U.S. Pat. No. 6,146,434 issued to Scalfani et al. (the '434 patent) and U.S. Pat. No. 5,107,567 to Ferrari et al. (the '567 patent).

Prior art versions of stick-type vacuum cleaners have several disadvantages. One of these disadvantages is a lack of adequate suction effective for removing dirt from the floor surface. Also, there is inadequate removal of dirt from the air stream, resulting from dirt having to fall against at least part of the force of the air flow, as air is pulled generally upward through the dirt collection unit. This lack of effective cleaning air flow reduces the ability of the stick-type vacuum cleaner to remove dirt and dust from the dirt-laden air.

Another disadvantage of the prior art stick vacuums is that the design of these vacuums does not allow for easy, clean removal of the dirt collection device. The prior art designs, such as the vacuum shown in the '434 patent, result in difficult or awkward removal of the dirt collection unit, creating extra effort and jarring motions by the user which spill the dirt collected by the vacuum when the dirt collection device is emptied.

Yet another disadvantage of stick vacuums of the prior art, as seen in the '434 patent and the '567 patent, is the difficulty in replacing the filter unit. The filters of the prior art vacuums are often located in awkward, hard-to-reach positions. With these cleaners, a user must pull the filter out of the housing at an awkward angle, causing dirt and debris resting on the filter to fall onto surfaces around the vacuum cleaner. Thus, removal of a dirty filter for cleaning or replacement, as must occasionally be done, becomes a time consuming and messy task.

Still another disadvantage to stick vacuums of the prior art is the escape of dirt-laden air from the vacuum cleaner. Because the dirt collection device is intended for repeated removal by a user, simple seals are often present between the collection device and the other components of the vacuum cleaner. Thus, when the dirt-laden air is drawn through the dirt collection device towards the filter, some of that air and accompanying dirt escapes through the simple seals surrounding the dirt collection device and into the user's atmosphere.

Accordingly, it is desirable to develop a new stick vacuum cleaner which would overcome the foregoing difficulties and others by providing improved air flow and better mounting of the dirt collection device and the filter.

SUMMARY OF THE INVENTION

In an exemplary embodiment of the invention, an upright vacuum cleaner is provided. The vacuum cleaner includes a floor nozzle having a suction inlet and a handle. A housing having a first portion is connected to the floor nozzle and a second portion is connected to the handle. The housing defines a cavity and at least one chamber. A dirt cup assembly is releasably connected to the housing and is at least partially received by the cavity and defines a cyclonic airflow chamber and includes a wall. An inlet duct is defined on the dirt cup assembly wall and a filter assembly is removably positioned in the dirt cup assembly. A motor assembly is disposed in the at least one chamber defined by the housing.

In another exemplary embodiment of the invention, a stick vacuum cleaner is provided. The vacuum cleaner includes a floor nozzle having a suction inlet and a housing is connected to the floor nozzle. The housing has a front panel and a rear panel and includes a cavity and at least one chamber spaced therefrom. The front panel of the housing defines a first aperture that opens into the cavity and the rear panel of the housing defines a second aperture that opens into the cavity, wherein the second aperture is smaller than the first aperture. A dirt cup is releasably mounted to the housing and is at least partially received in the cavity, wherein the dirt cup extends into the first aperture and into the second aperture when mounted on the housing and the dirt cup is removable from the housing in a frontal direction. A motor assembly is disposed in the at least one chamber defined by the housing.

In yet another exemplary embodiment of the invention, a stick vacuum cleaner is provided. The vacuum cleaner includes a floor nozzle having a suction inlet, a main handle and a housing having a first portion connected to the floor nozzle and a second portion that is connected to the main handle. The housing defines a cavity and at least one chamber. A dirt cup is releasably connected to the housing and is at least partially received by the cavity, wherein the dirt cup is movable in relation to the housing from a use position to an emptying position. A dirt cup handle is connected to the dirt cup assembly and is spaced from the main handle, wherein the stick vacuum cleaner may be lifted by the dirt cup handle when the dirt cup is in the use position. A motor assembly is disposed in the at least one chamber defined by the housing.

In still another exemplary embodiment of the invention, a stick vacuum cleaner is provided. The vacuum cleaner includes a floor nozzle having a suction inlet and a housing connected to the floor nozzle. A dirt cup assembly is releasably connected to the housing and the dirt cup assembly includes a base and walls which cooperate to define a cavity. An inlet duct is located on one of the base and walls of the dirt cup assembly. A filter support element is mounted on one of the base and walls of the dirt cup assembly and a filter is selectively mounted on the filter support element.

In yet another exemplary embodiment of the invention, a stick vacuum cleaner is provided. The vacuum cleaner includes a floor nozzle having a suction inlet A housing is connected to the floor nozzle and defines a cavity and at least one chamber. A dirt cup assembly is releasably connected to the housing and is at least partially received by the housing cavity, wherein the dirt cup assembly includes a front wall, a rear wall, a first side wall, a second side wall and a base wall, and the walls are interconnected to define a dirt cup cavity. A filter assembly is mounted in the dirt cup cavity and the filter assembly includes a top wall. A gasket extends away from an upper surface of the filter assembly top wall. A skirt extends away from a lower surface of the filter assembly top wall in a manner offset from the gasket, wherein at least one of the walls of the dirt cup assembly includes an upper portion having a projection, and wherein the filter assembly top wall gasket and skirt cooperate with the dirt cup wall projection to form a labyrinth seal. A motor assembly is disposed in the at least one chamber defined by the housing.

In still another exemplary embodiment of the invention, an upright vacuum cleaner is provided. The vacuum cleaner includes a floor nozzle having a suction inlet and a housing having a lower portion that is connected to the floor nozzle and an upper portion that is mounted on the lower portion. The lower portion of the housing defines at least one chamber and an air conduit and the air conduit is in fluid connection with the suction inlet. The upper portion of the housing defines a first cavity and a dirt cup assembly is releasably connected to the housing and is at least partially received by the first cavity. The dirt cup assembly includes at least one exterior wall and defines a second cavity. An inlet duct is located on the dirt cup assembly exterior wall in fluid communication with the air conduit when the dirt cup assembly is received in the first cavity, whereby air is drawn in through the suction inlet, through the air conduit, through the inlet duct and into the second cavity. The dirt cup assembly includes a base wall that defines an exhaust port, through which the air in the second cavity exits the dirt cup.

In yet another exemplary embodiment of the invention, an upright vacuum cleaner is provided. The vacuum cleaner includes a housing which comprises a floor nozzle and defines a first cavity and at least one chamber. A dirt cup is releasably connected to the housing and is at least partially received in the first cavity and defines a second cavity. The dirt cup includes a conversion port for above-the-floor cleaning and a motor assembly is disposed in the at least one chamber defined by the housing.

BRIEF DESCRIPTION OF THE DRAWINGS

The invention may take form in certain components and structures, a preferred embodiment of which will be illustrated in the accompanying drawings, wherein.

DETAILED DESCRIPTION OF THE PREFERRED EMBODIMENTS

Figure 1:
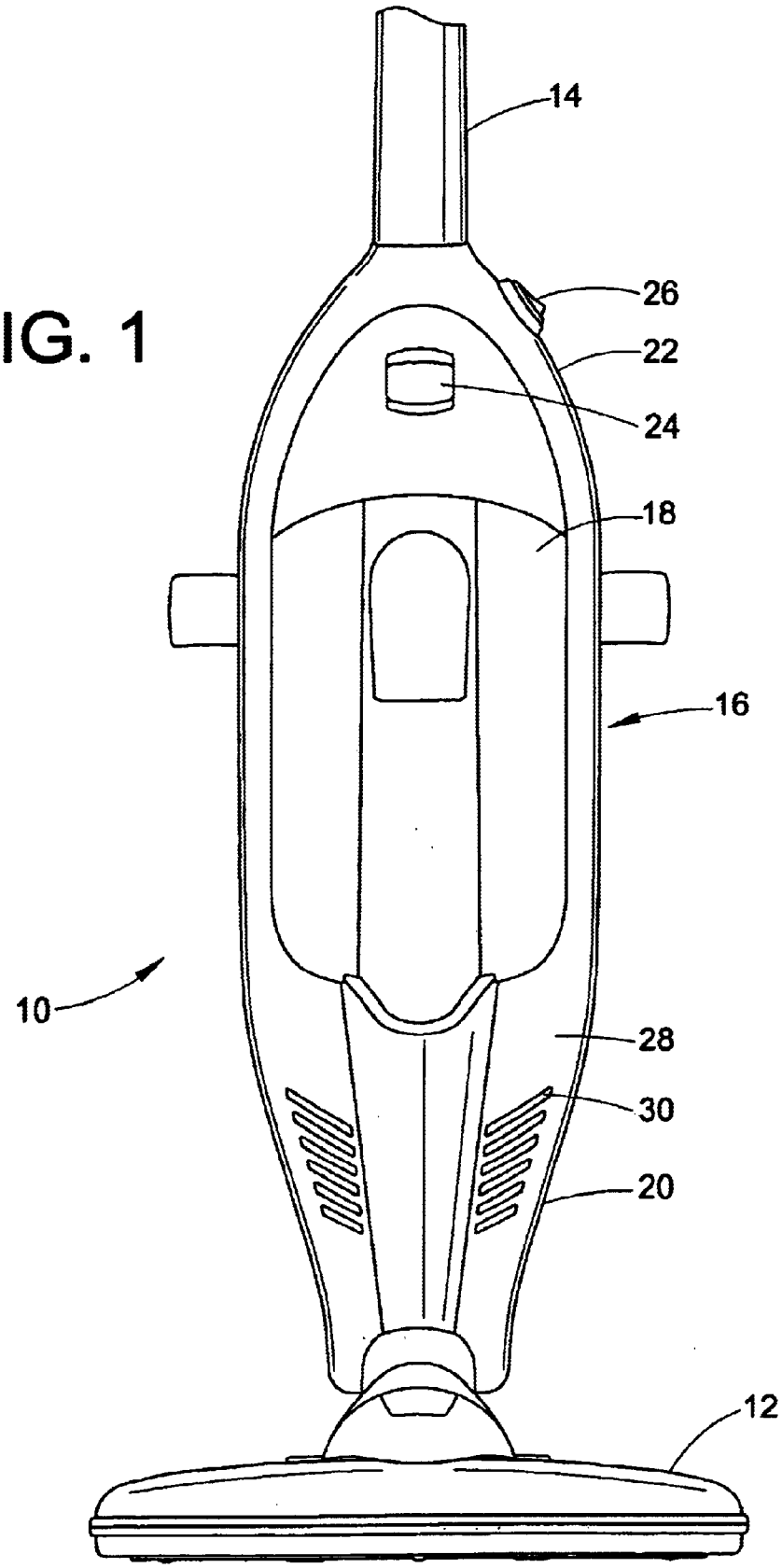
FIG. 1 is a front elevational view of a portion of a stick vacuum cleaner in accordance with the present invention.

Referring now to the drawings, wherein the showings are for purposes of illustrating a preferred embodiment of the invention only and not for purposes of limiting the same, FIG. 1 shows an upright stick vacuum cleaner 10 in accordance with the present invention. While a stick vacuum cleaner is shown, the invention could also be used on other types of upright vacuum cleaners. The stick vacuum cleaner 10 comprises a floor nozzle 12, a main handle 14, and a housing 16, including a dirt cup assembly 18, which extends between the floor nozzle 12 and the main handle 14. A first portion or first end 20 of the housing 16 is pivotally connected to the floor nozzle 12 and a second portion or second end 22 of the housing 16 is connected to the main handle 14.

A latch actuator 24 is included on the dirt cup assembly 18 and a power switch 26 is mounted on the upper portion 22 of the housing 16. In addition, the housing 16 has a front panel 28 which defines exhaust vents 30.

Figure 2:
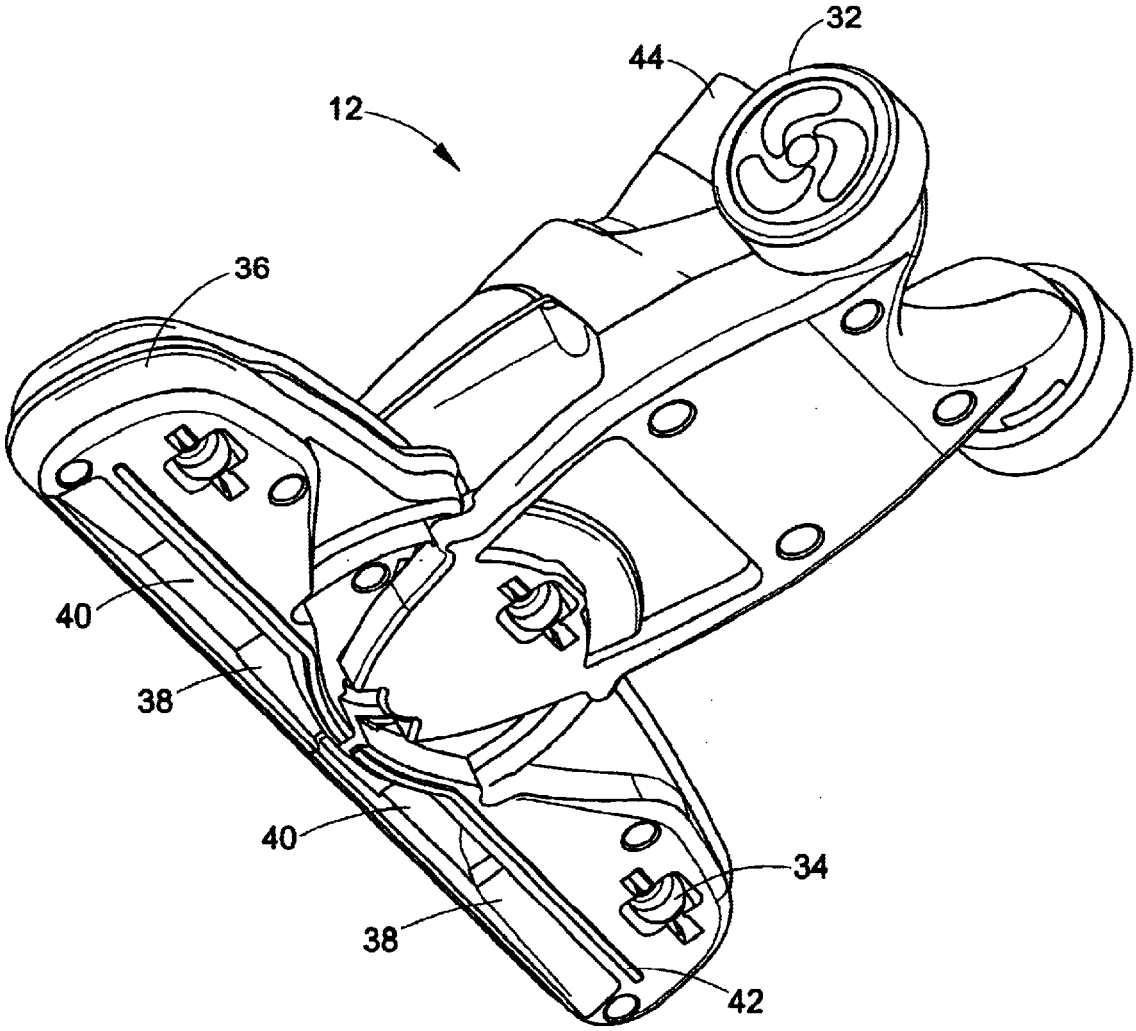
FIG. 2 is an enlarged bottom perspective view of a floor nozzle of the vacuum cleaner of FIG. 1.

With reference now to FIG. 2, the floor nozzle 12 includes rear wheels 32 and relatively small front wheels 34 which cooperate to provide mobility along the surface to be cleaned by the vacuum cleaner 10. A bumper 36 protects the floor nozzle 12 as well as objects with which the floor nozzle 12 may come into contact. The floor nozzle 12 defines at least one suction channel 38 which leads to at least one suction inlet 40. The suction inlet 40 and the suction channel 38 cooperate to provide an intake area for dirt-laden air. At least one bristle strip 42 is located adjacent the suction channel 38 to assist in the gathering of dirt particles and the deflection of dirt-laden air into the suction channel 38 and the suction inlet 40. Instead of bristles, the strip 42 may be of soft yet strong material, such as felt, to prevent damage to delicate floor surfaces. A pivot tube 44 is in fluid connection with the suction nozzle 40 to convey dirt-laden air through the floor nozzle 12. Other features of the floor nozzle 12 will be described in detail below.

Figure 3:
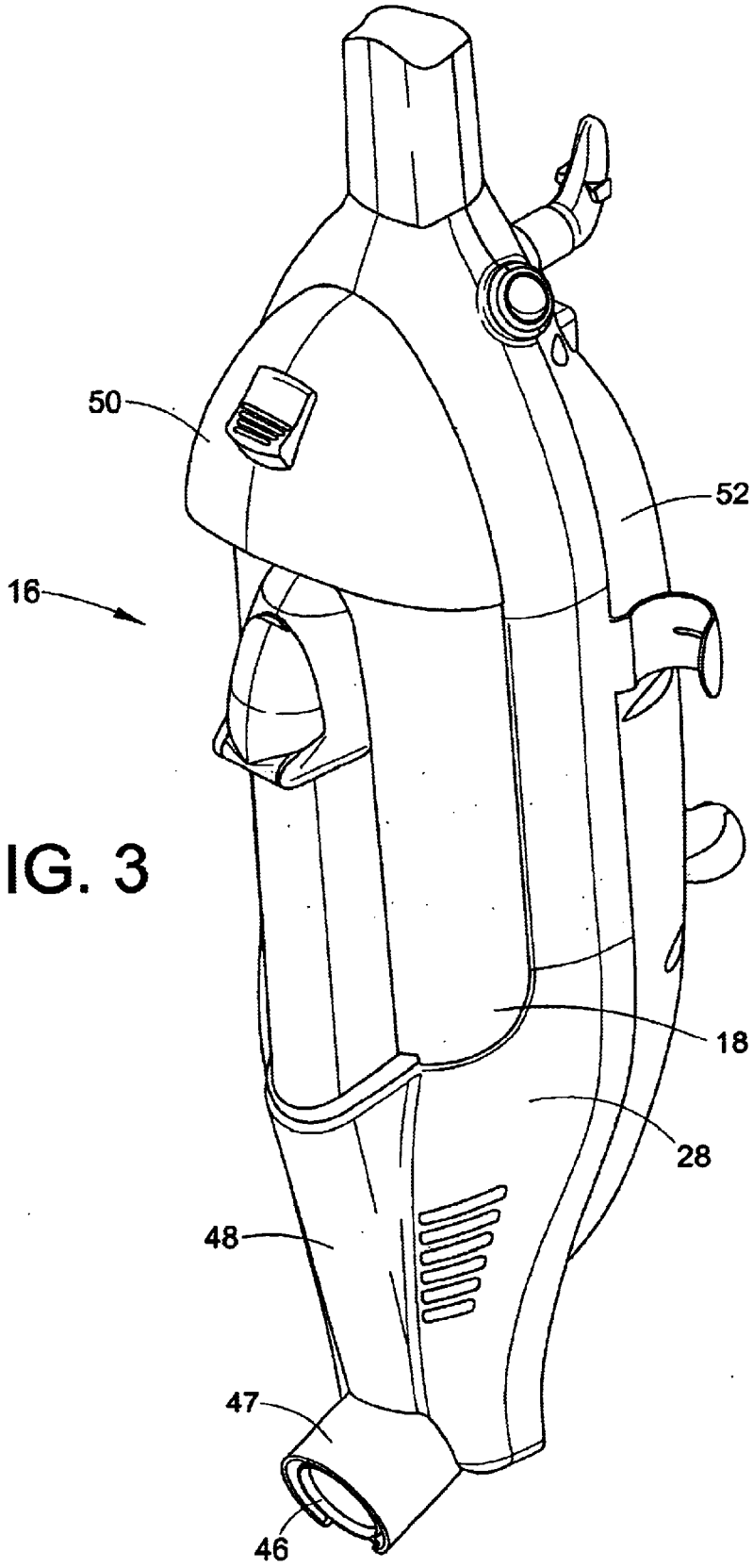
FIG. 3 is an enlarged perspective view of a housing and a dirt cup of the vacuum cleaner of FIG. 1.

With reference to FIG. 3, a lower hose 46 is in fluid communication with the pivot tube 44 of the floor nozzle 12 (referring back to FIG. 2), whereby dirt-laden air is drawn into the housing 16. A hose connector 47 facilitates a pivot connection between the housing 16 and the floor nozzle 12. The floor nozzle 12 can be selectively separated from the housing 16 when the pivot tube 44 is removed from the hose connector 47. A housing conduit 48 is in fluid connection with the lower hose 46 and conveys dirt-laden air to the dirt cup 18. The dirt cup 18 includes a handle 50 that is utilized for both the removal of the dirt cup 18 from the housing 16, to be described below, and the lifting of the entire vacuum 10 when the dirt cup 18 is in a closed, use position to clean elevated or hard-to-reach surfaces with the floor nozzle 12 and to easily transport the cleaner 10. Located behind the front panel 28 of the housing 16 is a rear panel 52.

Figure 4:
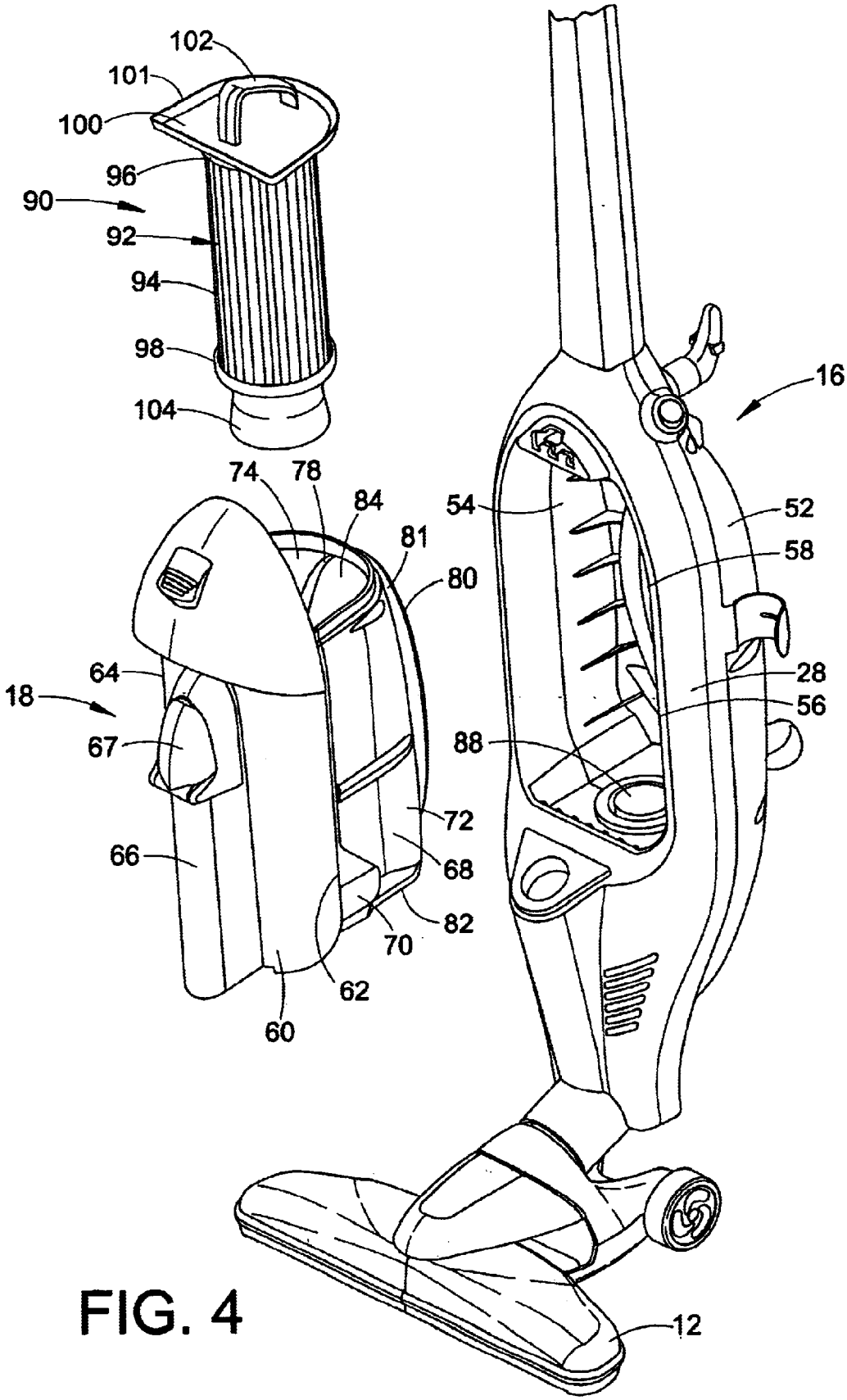
FIG. 4 is an exploded perspective view of the vacuum cleaner of FIG. 1.

Turning now to FIG. 4, the housing 16 defines a housing cavity or first cavity 54, which at least partially receives the dirt cup assembly 18. This is facilitated by a first aperture 56 defined in the front panel 28 of the housing 16 and a second aperture 58 (see also FIG. 6) defined in the rear panel 52 of the housing 16. In the illustrated embodiment, the second aperture 58 is smaller in surface area than the first aperture 56.

The dirt cup 18 includes a front wall 60 which has a first side edge 62 and a second side edge 64. The front wall 60 of the dirt cup 18 also includes an inlet duct 66. A conversion port 67 for above-the-floor cleaning is defined in the inlet duct 66 of the dirt cup 18 and will be described in greater detail below. A first side wall 68 of the dirt cup 18 has a proximal edge 70 and a distal edge 72. A second side wall 74 of the dirt cup 18 also includes a proximal edge (not visible) and a distal edge 78. The first 68 and second 74 side walls extend opposite and generally parallel to one another. The proximal edge 70 of the first side wall 68 and the proximal edge of the second side wall 74 are connected to the front wall 60 of the dirt cup 18. The proximal edge 70 of the first side wall 68 is near the first side edge 62 of the front wall 60 and the proximal edge of the second side wall 74 is near the second side edge 64 of the front wall 60. However, the first side edge 62 of the front wall 60 extends past the proximal edge 70 of the first side wall 68 and the second side edge 64 of the front wall extends past the proximal edge of the second side wall 74, forming wings.

Figure 6:
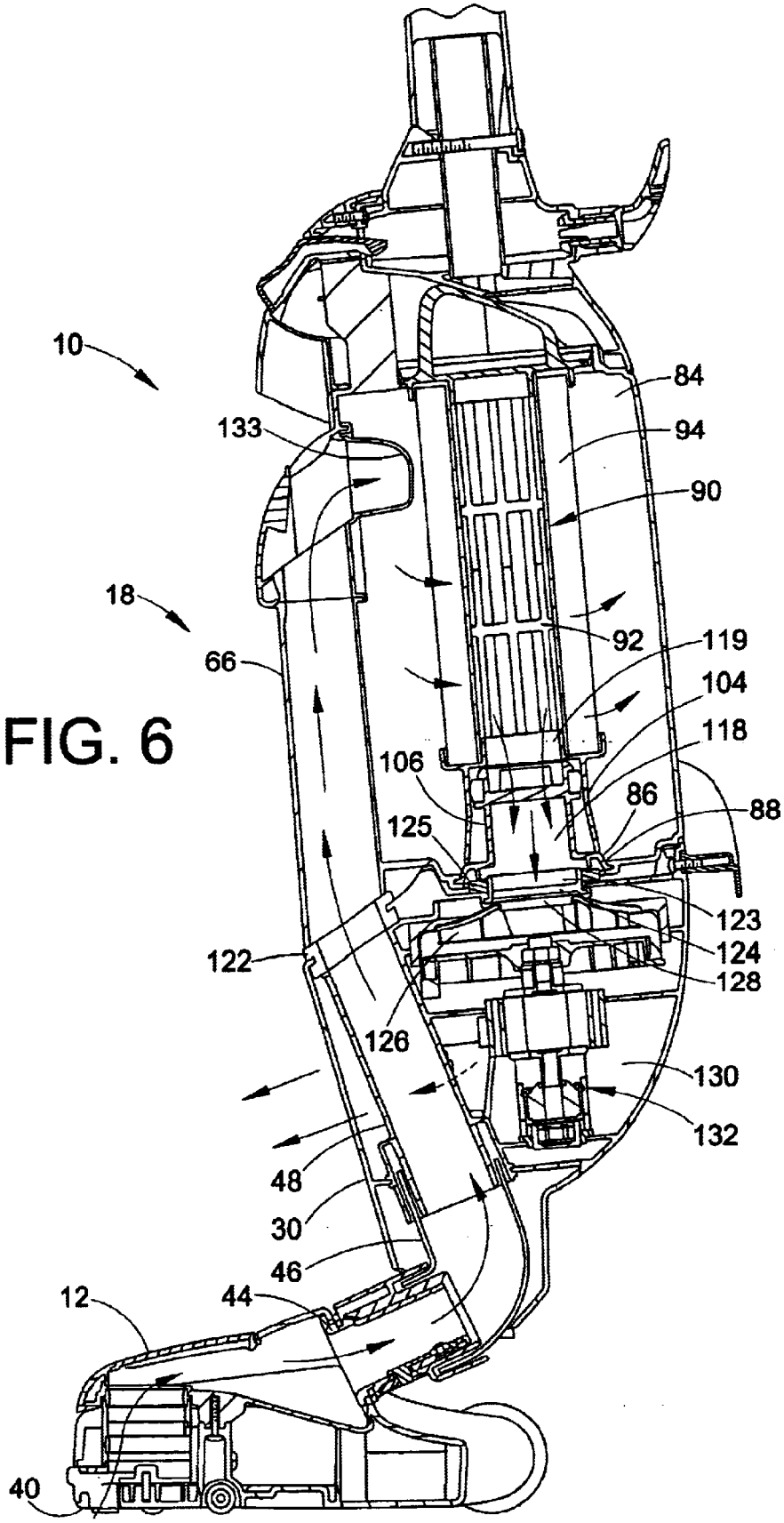
FIG. 6 is a side cross-sectional view of the vacuum cleaner of FIG. 1.

The distal edge 72 of the first side wall 70 and the distal edge 78 of the second side wall 74 each connect to a rear wall 80 of the dirt cup 18. The rear wall 80 extends opposite and generally parallel to the front wall 60 and includes a contoured portion 81. Connected near the bottom of the front wall 60 and at the bottom of the first side wall 68, the second side wall 74 and the rear wall 80 of the dirt cup 18 is a base wall 82. The front wall 60, first side wall 68, second side wall 74, rear wall 80 and base wall 82 form a dirt cup cavity 84, a second cavity that functions as a cyclonic chamber. With reference now to FIG. 6, the base wall 82 defines an orifice that is an exhaust duct or port 86 which aligns with an orifice 88 defined in the housing 16.

Figure 7:
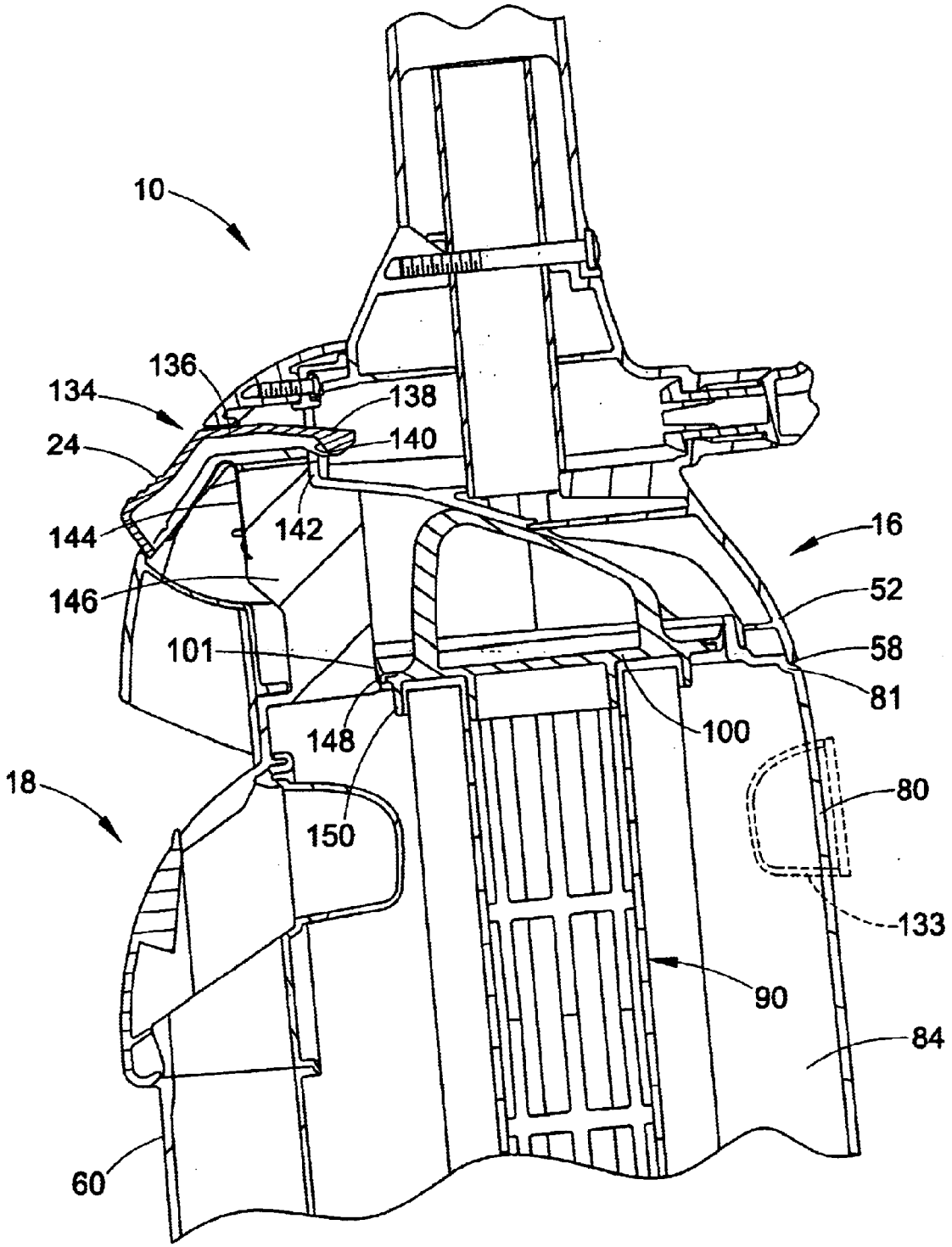
FIG. 7 is an enlarged side cross-sectional view of the upper portion of the vacuum cleaner of FIG. 5.

When the dirt cup 18 is engaged in the housing 16 for use of the vacuum cleaner, the first side wall 68, second side wall 74, rear wall 80 and base wall 82 pass through the first aperture 56 and are received in the housing cavity 54. As shown in FIG. 7, the contoured portion 81 of the rear wall 80 of the dirt cup 18 is received by and cooperates with the second aperture 58 to provide alignment and an additional mechanical seat for the dirt cup 18 in a use position. The front wall 60 of the dirt cup 18 forms an exterior front wall, at least a portion of which remains substantially flush with the front panel 28 of the housing 16 when the dirt cup 18 is in a use position. This design facilitates easy removal of the dirt cup 18 for emptying as will be described in greater detail below.

With continuing reference to FIG. 4, a filter assembly 90 is shown in a removed position from the dirt cup 18. The filter assembly 90 includes a filter cage 92 upon which a filter medium 94 is mounted. In this embodiment, the filter medium 94 is made of a pleated plastic material that is known in the art. One type of filter medium 94 comprises polytetrafluoroethylene (PTFE), a polymeric, plastic material commonly referred to by the registered trademark TEFLON®. The low coefficient of friction of a filter medium comprising PTFE facilitates cleaning of the filter element by washing. The pleated filter medium 94 can be defined substantially or entirely from GORE-TEX®, a PTFE-based material commercially available from W. L. GORE & ASSOCIATES, Elkton, Md. 21921. The GORE-TEX® filter medium, also sold under the trademark CLEANSTREAM® by W. L. GORE & ASSOCIATES, is an expanded PTFE membrane defined from billions of continuous, tiny fibrils. The filter blocks the passage of at least 99% of particles 0.3 $\mu$m in size or larger. Although not visible in the drawings, the inwardly and/or outwardly facing surface of the CLEANSTREAM® filter medium 94 can be coated with a mesh backing material of plastic or the like for durability since it enhances the abrasion-resistance characteristics of the plastic filter material. The mesh may also enhance the strength of the plastic filter material somewhat.

The cage 92 includes a proximal end 96 and a distal end 98. A top wall 100 is connected to the proximal end 96 of the cage 92 and a filter top gasket 101 is disposed about the periphery of the upper surface of the top wall 100. The top gasket 101 functions to seal the dirt cup cavity 84, as will be described in greater detail below. A filter handle 102 is mounted on the upper surface of the top wall 100 to allow a user to easily grasp the filter assembly 90 for removal from the dirt cup 18 for cleaning or replacement. Connected to the distal end 98 of the filter cage 92 is a bottom support 104.

Figure 5:
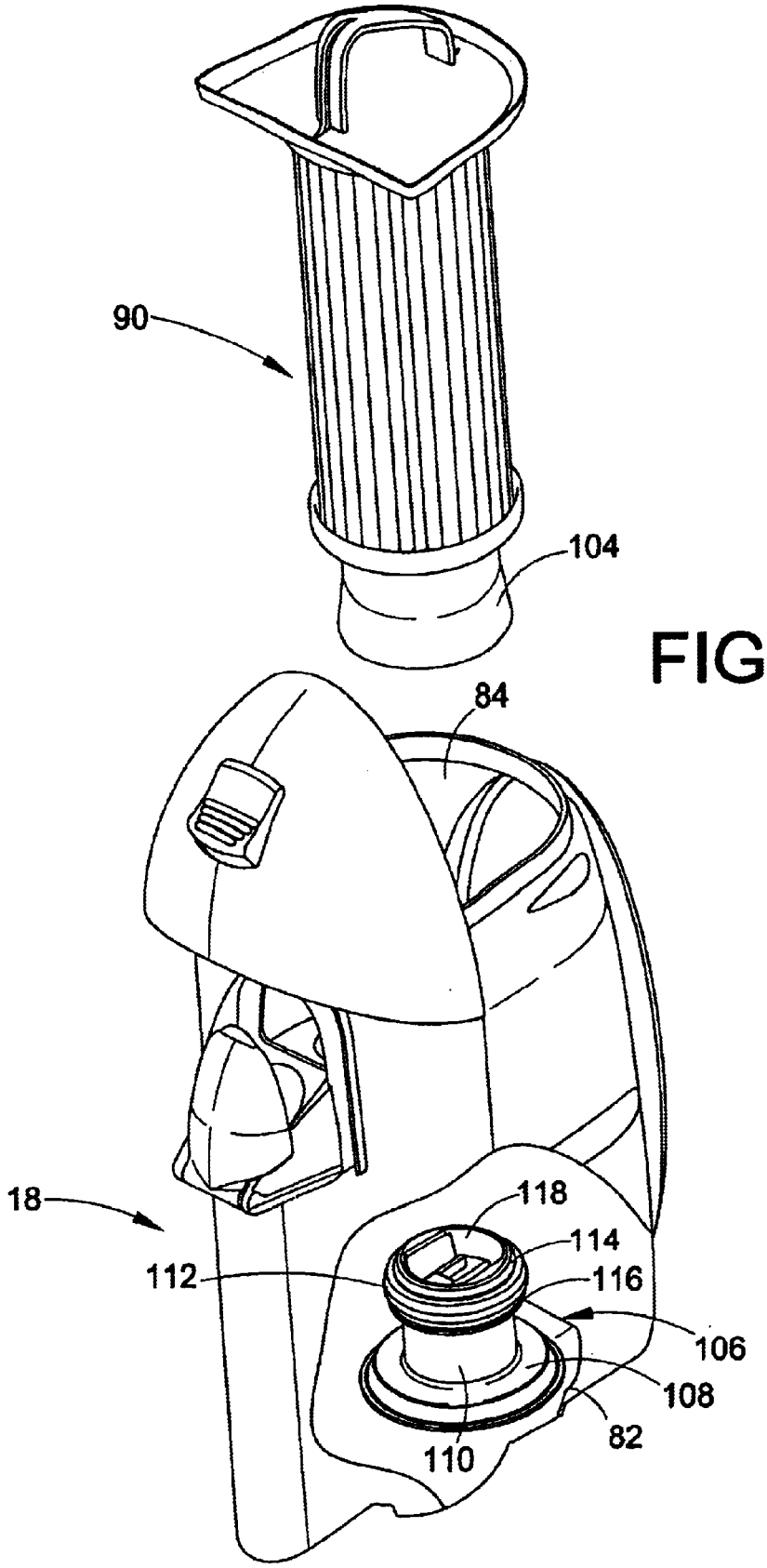
FIG. 5 is an enlarged perspective view of the dirt cup of the vacuum cleaner of FIG. 4 with a portion cut away.

Turning now to FIG. 5, the filter assembly 90 is concentrically positioned within the dirt cup cavity 84, facilitated by the bottom support 104 of the filter assembly 90 releasably engaging a filter support tube or element 106. The support tube 106 includes a base 108 that surrounds the orifice 86 defined in the base wall 82 of the dirt cup 18. The support tube 106 may be integrally molded to the base wall 82 of the dirt cup 18 or it may be an independent component that is connected to the base wall 82 by fasteners, molded lips, a snap fit, an interference fit or other means known to those skilled in the art. The support tube 106 also includes a neck 110 upon which a sealing element or member 112, such as a gasket or an o-ring, is mounted. The sealing element 112 is retained between an upper shoulder 114 and a lower shoulder 116 extending from the neck 110 of the support tube 106. The sealing element 112 may alternatively be located on the inner diameter of the bottom support 112. Thus, when the filter assembly 90 is inserted into the dirt cup cavity 84, the bottom support 104 of the filter assembly 90 slides over the support tube 106 to provide a releasable connection that is sealed by the sealing element 112. This connection also provides axial alignment of the filter assembly 90 and the exhaust duct 86.

The support tube 106 includes an opening 118 which allows air passing through the filter medium 94 and through the filter cage 92 to be drawn through the support tube 106 and out of the dirt cup 18. Located within the opening 118 is a support member 119. Because the bottom support 104 of the filter assembly 90 may flex when it is in contact with the base 108 of the support tube 106, the support member 119 cooperates with the wall of the support tube 106 to provide support for the distal end 98 of the filter cage 92 and prevent excessive movement of the filter assembly 90 in a downward direction.

With reference to FIG. 6, When the vacuum cleaner 10 is in use, the air follows a short and efficient flow path as represented by the arrows. Dirt-laden air is drawn in through the suction inlet 40 in the floor nozzle 12 and moves up through the floor nozzle 12, through the pivot tube 44 and into the lower hose 46. The dirt-laden air is then drawn through the housing conduit 48 and into the inlet duct 66 of the dirt cup 18. A support seal 122 provides an effective seal between the housing conduit 48 and the inlet duct 66 of the dirt cup 18. The dirt-laden air is then drawn to an upper portion of the dirt cup 18 and enters the dirt cup cavity 84, tangentially so that the cavity forms a cyclonic air chamber. At this point, heavier dirt particles are flung outwardly by centrifugal action and fall to the base wall 82 of the dirt cup 18 by gravity. Lighter particles are drawn to the filter medium 94 as the air is pulled to the interior of the filter assembly 90. The filter medium 94 traps smaller dirt particles that have not fallen to the base of the dirt cup 18.

Substantially clean air is thus drawn into the interior of the filter assembly 90 and passes through the opening 118 of the filter support tube 106. The air passes through a secondary filter 123 that is supported by a grill 124 and is surrounded by a seal 125, ensuring that clean air enters a fan 126 in case there is a gap or break in the filter material 94. When the dirt cup 18 is in a removed or cleaning position, a user has easy access to the secondary filter 123 for cleaning or replacement by reaching into the housing cavity 54 (referring back to FIG. 4).

Once the air passes through the secondary filter 123 it enters the fan 126 through a fan inlet 128. Clean air is then blown into the motor chamber 130, across the motor assembly 132 and out through the vents 30 defined in the housing 16. The filter assembly 90, the exhaust duct 86 of the dirt cup 18, the fan inlet 128, the fan 126 and the motor assembly 132 can be aligned along a longitudinal axis to promote efficient air flow.

As is evident from FIG. 6, a deflector 133 is located on the front wall 60 of the dirt cup 18 at a point where the inlet duct 66 opens into the cyclonic chamber 84. The deflector 133 helps to create a generally spiraling flow direction in the cyclonic chamber 84, with gravity urging dirt particles to fall to the base of the dirt cup 18. The downward airflow, since the outlet of the dirt cup is located on the base wall 82, is with the force of gravity instead of against it, encouraging particles to fall to the base of the dirt cup 18 and enhancing the ability of the vacuum 10 to remove dirt from the air stream. It is important to note that the deflector 133 may be a member that can be located on many alternative surfaces to create a tangential inlet to the cyclonic chamber 84. While the deflector 133 is shown on the front wall 60 of the dirt cup 18 in FIG. 6, it may be located, for example, on the rear wall 80 of the dirt cup 84 (as shown in hidden form in FIG. 7), or on the top wall 100 of the filter assembly 90.

Turning now to FIG. 7, a latch assembly 134 facilitates the removable connection of the dirt cup 18 to the housing 16. The latch assembly 134 includes a latch arm 136 having an enlarged distal end 138. The distal end 138 includes a contact face 140 which engages a shoulder 142 of the housing 16 when the dirt cup 18 is in a closed, use position.

When the dirt cup 18 is to be removed for cleaning, the user presses the latch actuator 24, causing the latch arm 136 to rotate upward. The contact face 140 of the distal end 138 moves to a point above the shoulder 142, allowing the dirt cup 18 to be removed. A spring 144 urges the contact face 140 against the shoulder 142 until the user presses the latch actuator 24 and causes the latch arm 136 to rotate.

Also shown in FIG. 7 is a labyrinth seal created between the filter assembly 90 and at least a portion of the dirt cup 18. The front wall 60 of the dirt cup 18 includes an upper portion 146 having a projection 148. The top wall 100 of the filter assembly 90 includes the filter top gasket 101 which extends away from the upper surface of the top wall 100. The top wall 100 also includes a skirt 150 that extends away from a lower surface of the top wall 100 in a manner offset from the top gasket 101. When the filter assembly 90 is seated in a use position within the dirt cup cavity 84, the top gasket 101 and skirt 150 of the top wall 100 cooperate with the projection 148 to form a labyrinth seal. The labyrinth seal provides an improved seal of the dirt-containing portion of the stick vacuum 10, i.e., the dirt cup cavity 84. This results in less dirt escaping from the vacuum cleaner 10.

FIG. 7 also illustrates the interaction between the rear wall 80 of the dirt cup 18 and the rear panel 52 of the housing 16. As mentioned above, the contoured portion 81 of the rear wall 80 of the dirt cup 18 is received by the second aperture 58, allowing the dirt cup 18 to firmly seat in the housing 16. In a use position, the rear wall 80 of the dirt cup 18 forms at least a portion of the exterior wall of the rear panel 52 of the housing 16.

Figure 8:
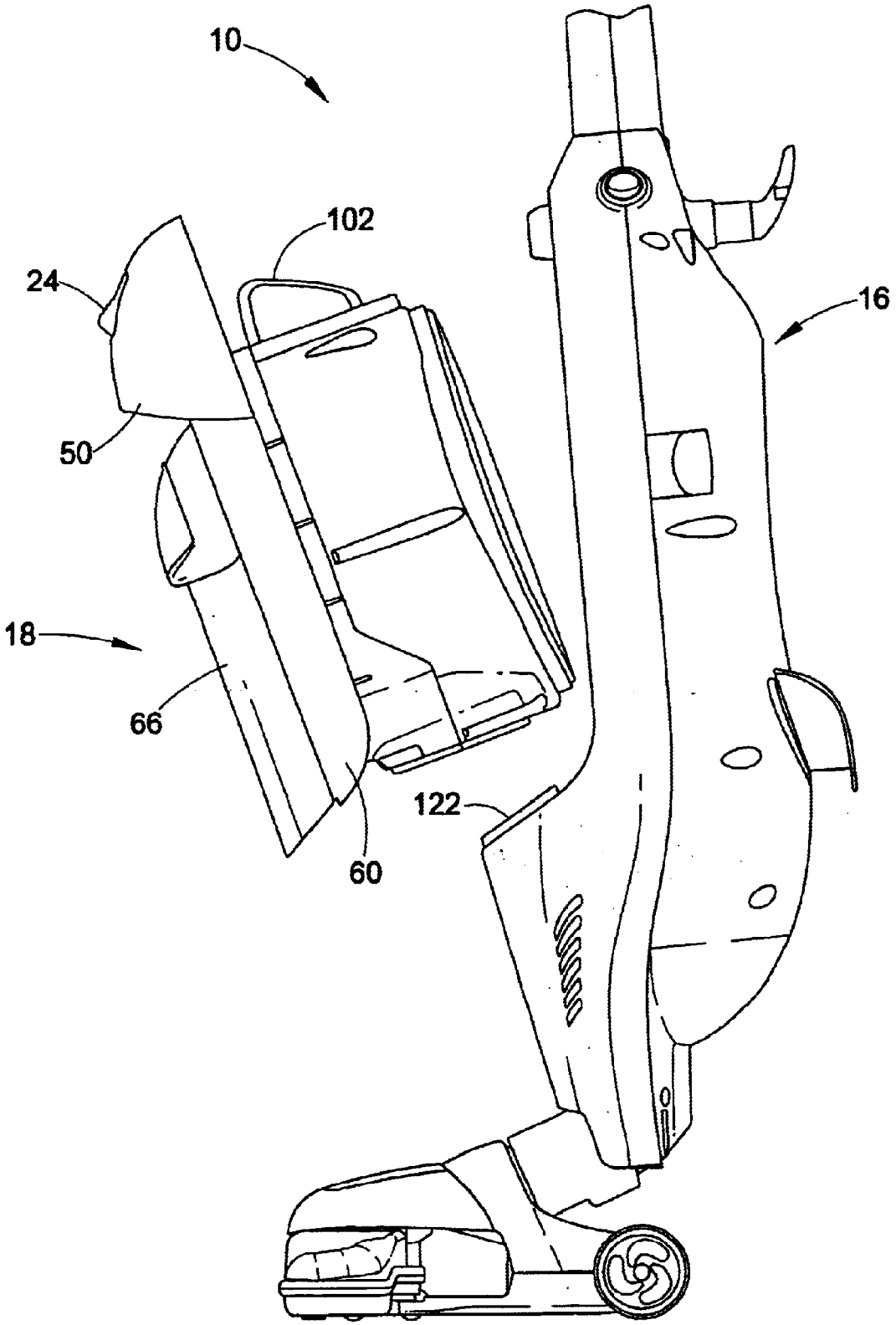
FIG. 8 is a side elevational view of the vacuum cleaner of FIG. 1 with the dirt cup in an emptying position.

With reference to FIG. 8, the dirt cup 18 is removed from the housing 16 by pressing on the latch actuator 24 allowing the dirt cup 18 to be easily removed from the housing by pulling on the dirt cup handle 50. When a user pulls the dirt cup handle 50 while depressing the latch actuator 24, the upper portion of the dirt cup 18 rotates away from the housing 16, whereby the dirt cup 18 may then be lifted by the handle 50 and taken for cleaning. Such cleaning entails the removal of dirt from the dirt cup 18 by lifting the filter assembly 90 via the filter handle 102. This also allows a cleaning of the filter medium 94 or replacement of the filter assembly 90 or the filter medium 94.

The downward slope of the support seal 122 between the housing conduit 48 and the dirt cup inlet duct 66, combined with an accompanying contour on the bottom of the front wall 60 of the dirt cup 18, encourages easy rotation of the dirt cup 18 away from the housing 16. The result is a dirt cup 18 that is easier to remove for cleaning, creating less effort by the user and considerably less mess.

The improved releasable engagement of the bottom support 104 (referring back to FIG. 5) of the filter assembly 90 with the filter support tube 106 of the dirt cup 18 allows the filter assembly 90 to be smoothly and easily removed from the dirt cup 18, reducing the amount of dirt and dust released during removal of the filter 90.

Figure 9:
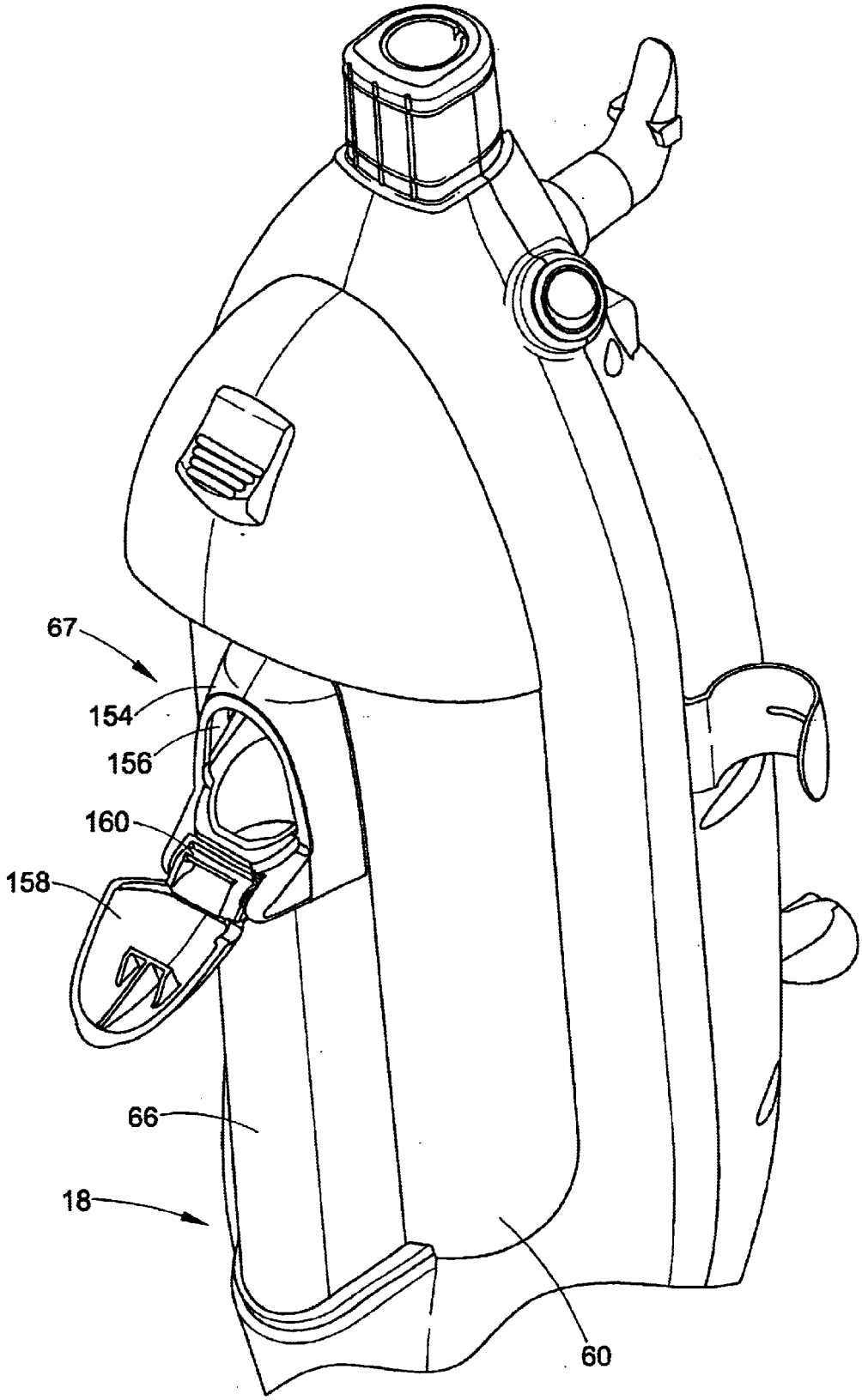
FIG. 9 is an enlarged perspective view of a portion of the vacuum cleaner of FIG. 3.

With reference again to FIG. 7, the conversion port 67 may be defined in the front wall 60 or the rear wall 80 of the dirt cup 18. In FIG. 9, it is shown as being defined in the front wall 60. More particularly, the conversion port 67 is located in an upper portion of the inlet duct 66. The conversion port 67 includes walls 154 which define a conversion port orifice 156. A door 158 covers and substantially seals the conversion port orifice 156 when the vacuum 10 is in a floor cleaning mode. In a closed position (referring back to FIG. 4), dirt-laden air is drawn up the inlet duct 66 through the conversion port 67 and into the dirt cup cavity 84. The door 158 can be spring-biased to remain in a closed, floor cleaning position. When a user desires to perform above-the-floor cleaning, the door 158 is pivoted about a hinge 160 into an open position, as shown in FIG. 9

Figure 10:
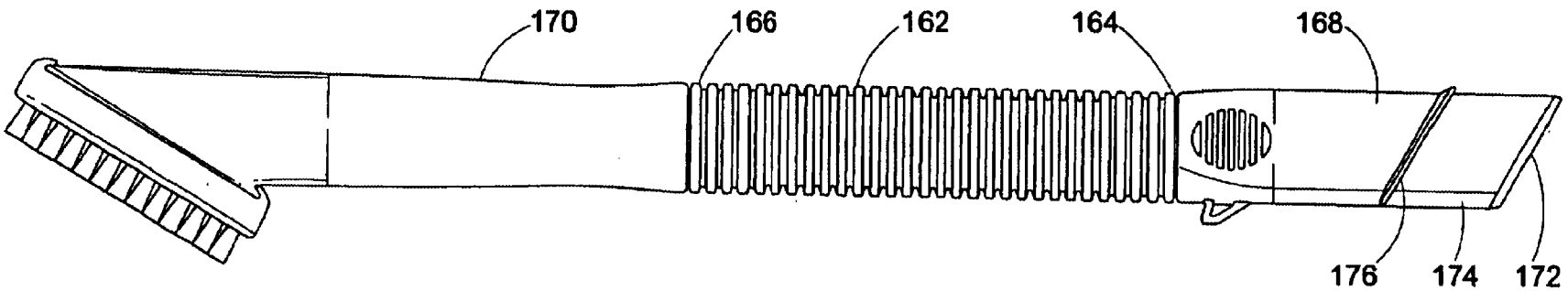
FIG. 10 is a side elevational view of an above-the-floor cleaning hose arrangement for the vacuum cleaner of FIG. 1.

With reference to FIG. 10, an above-the-floor cleaning hose 162 is shown. The hose 162 comprises a first end 164 and a second end 166. The first end 164 terminates in a conversion adapter 168 and the second end connects to a suitable known tool. Illustrated is a crevice tool 170. This may be an integral part of the hose 162 or a separate tool that slips onto the second end 166 of the hose 162, as known in the art.

The conversion adapter 168 includes a distal end 172 that extends through the conversion port orifice 156 (referring back to FIG. 9) and is in fluid communication with the dirt cup cavity 84 (referring back to FIG. 6) when the vacuum cleaner 10 is in an above-the-floor cleaning mode. Proximate the distal end 172 is an inserted portion 174 that terminates at a shoulder 176. The inserted portion 174 is of a length of sufficient to allow the distal end 172 to extend through the conversion port orifice, across the inlet duct 66 of the dirt cup 18 to the dirt cup cavity 84. Because the deflector 133 is located on the front wall 60 of the dirt cup 18 at a point where the inlet duct 66 opens into the dirt cup cavity 84, the distal end 172 of the adapter 168 may be proximate the deflector 133 to provide fluid communication to the dirt cup cavity 84.

The exterior size and shape of the inserted portion 174 are of dimensions which approximate the circumference of the conversion port orifice 156 and the inner dimension of the inlet duct 66 This allows the adapter 168 to be inserted in the conversion port orifice 156 easily, while maintaining a snug fit, and to effectively block the duct 66 so that the suction created by the fan 126 is substantially diverted to the hose 162 rather than the floor nozzle 12. The shoulder 176 has a circumference greater than that of the conversion port orifice 156, which provides a positive mechanical stop for the adapter 168 when it is inserted into the orifice 156.

Figure 11:
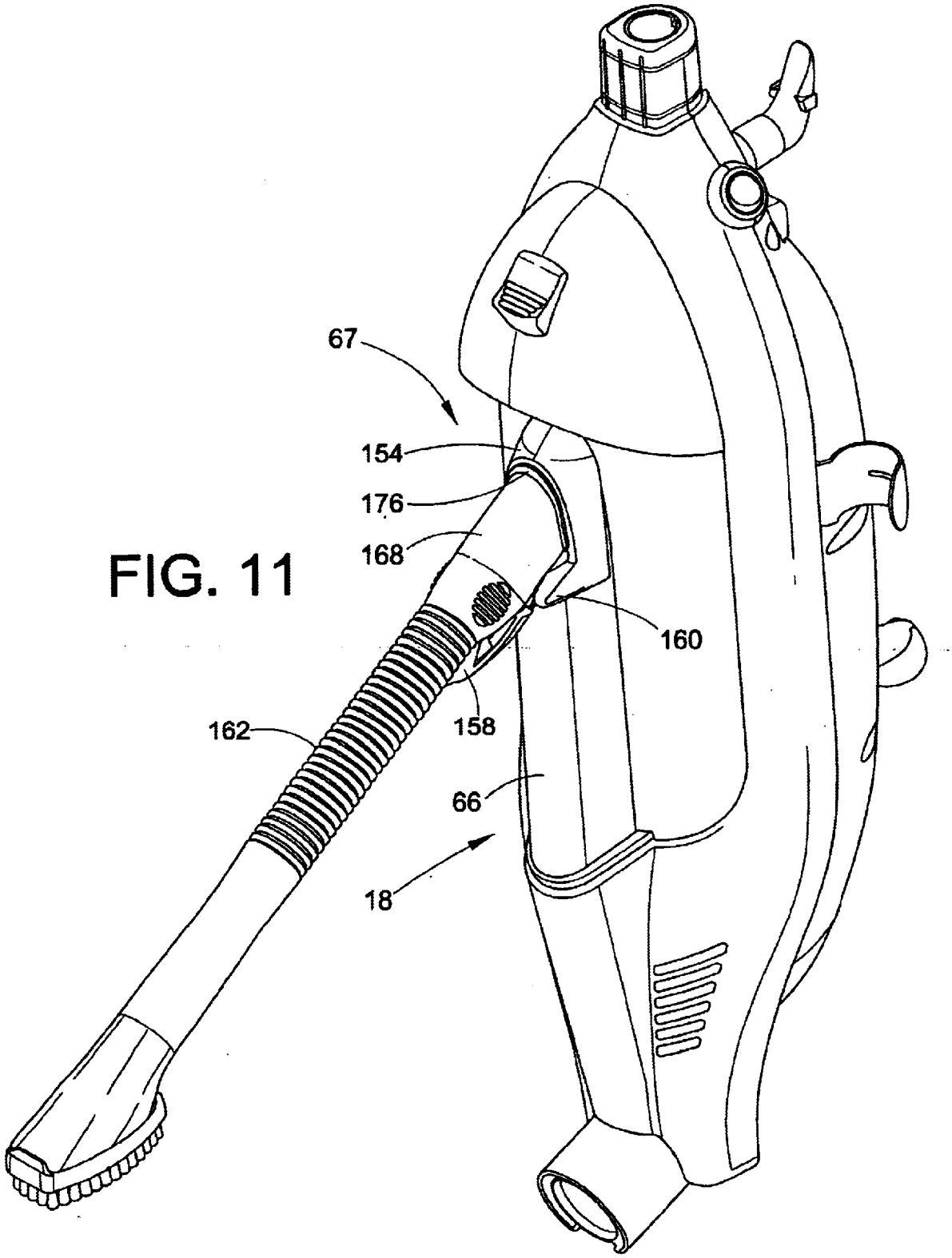
FIG. 11 is an enlarged perspective view of a portion of the vacuum cleaner of FIG. 1 with the above-the-floor cleaning hose in a use position.

With reference to FIG. 11, the snug fit of the adapter 168 in the conversion port orifice 156 can be seen. In this position, the distal end of the adapter 172 is in fluid communication with the dirt cup cavity 84. This arrangement facilitates an easy transfer from the floor cleaning mode to the above-the-floor cleaning mode and back to the floor cleaning mode.

Figure 12:
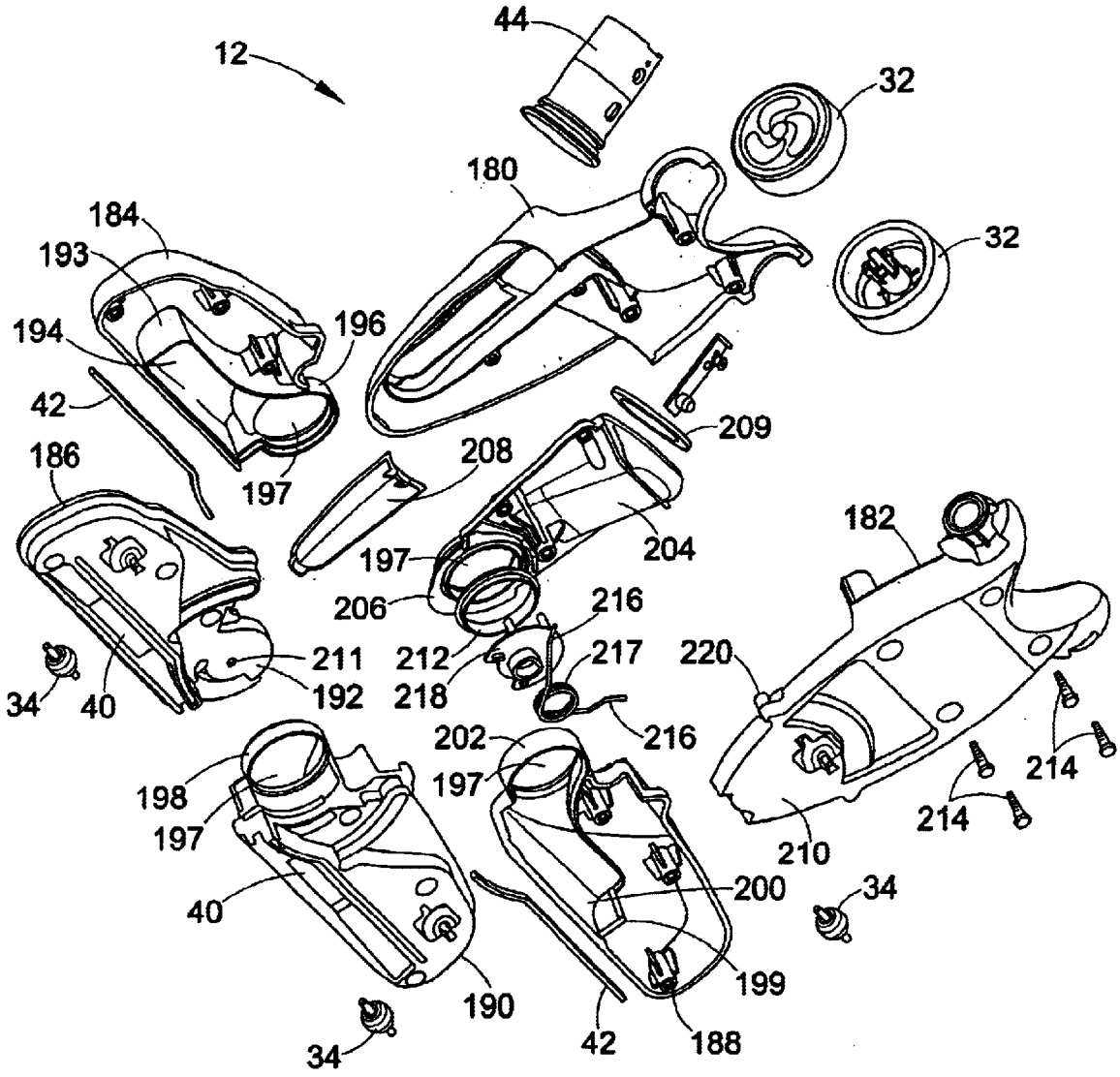
FIG. 12 is an exploded bottom perspective view of the floor nozzle of FIG. 1.

Turning now to FIG. 12, the nozzle 12 has pivotable sides that allow the vacuum cleaner 10 to operate in corners and confined areas. The nozzle 12 includes a central housing which comprises a top cover 180 connected to a base plate 182. The top cover 180 and the base plate 182 of the central housing retain a left nozzle head, comprised of an upper plate 184 and a lower plate 186, and a right nozzle head, comprised of an upper plate 188 and a lower plate 190. The left nozzle head lower plate 186 includes the suction inlet 40 and a central dirt path base 192. The left nozzle upper plate 184 includes walls 193 that define a channel 194 which conveys dirt-laden air to a dirt path ring 196 which defines a central dirt path 197.

The right nozzle lower plate 190 includes the suction inlet 40 and a dirt path ring 198 defining an orifice for the central dirt path 197. The right nozzle upper plate includes walls 199 that define a channel 200 which conveys dirt-laden air to a dirt path ring 202 which defines an orifice for the central dirt path 197.

A dirt path bottom cover 204 includes a distal end 206 which defines an orifice for the central dirt path 197. In an assembled state, the left nozzle lower 186 and upper 184 plates convey the dirt-laden air from the suction inlet 40 along the channel 194 to the central dirt path 197 formed by the central dirt path base 192 and the ring 196. The right nozzle lower plate 190 and the right nozzle upper plate 188 convey dirt-laden air from the suction inlet 40 along the channel 200 to the central dirt path 197 formed by the central dirt path rings 198, 200. Thus, dirt-laden air is drawn in through separate nozzle heads and conveyed to a central dirt path 197. The dirt-laden air is then drawn through the orifice in the distal end 206 of the dirt path bottom cover 204 and into a channel formed between the dirt path bottom cover 204 and the top cover 180.

The top cover 180 includes an access cover 208 to allow cleaning of the dirt path bottom cover 204 and the channel formed therebetween. A retaining ring 209 facilitates the connection of the dirt path bottom cover 204 and the top cover 180 to the pivot tube 44 which conveys dirt-laden air to the housing.

The left nozzle upper 184 and lower 186 plates and the right nozzle upper 188 and lower 190 plates are secured and aligned between the top cover 180 and the base plate 182. Assisting in the alignment is the dirt path bottom cover 204, which is secured between the top cover 180 and the base plate 182. The base plate 182 includes a distal end 210 which aligns vertically and cooperates with the distal end 206 of the dirt path bottom cover 204. The central dirt path base 192, the dirt path ring 196 of the left nozzle upper plate 184, the dirt path ring 198 of the right nozzle lower plate 190 and the dirt path ring 202 of the right nozzle upper plate 188 seat vertically upon one another from the distal end 210 of the base plate 182 to the distal end 206 of the dirt path bottom cover 204.

A pin, fastener, projection or other similar means is connected to the distal end 210 of the base plate 182 and passes through an orifice 211 defined in the center of the central dirt path base portion 192 of the left nozzle lower plate 186. The central dirt path base 192 and rings 196, 198 and 200 include flanges, lips or similar features to allow them to engage one another yet still rotate. A bushing 212 aligns and secures the uppermost central dirt path ring 202 to the distal end 206 of the dirt path bottom cover 204. To keep constant force on the central dirt path base 192 and rings 196, 198 and 200 in order to maintain alignment, fasteners 214 or other suitable means known in the art, such as snap-fit, welding or other mechanical means are used to connect the top plate 180 to the base plate 182 and secure the dirt path bottom cover 204 therebetween. This in turn centrally secures the left nozzle head 184, 186 and the right nozzle head 188, 190.

The pin that passes through the orifice 211 defined in the central dirt path base 192 and the bushing 212 provides an axis around which the left nozzle 184, 186 and the right nozzle 188, 190 pivot In addition, smooth surfaces on the dirt path ring 196 of the left nozzle upper plate 186 and on the dirt path ring 198 of the right nozzle lower plate 190 allow the left and right nozzles to independently pivot. The rotation can be centered about a vertical pivot axis which passes through the central housing. In the illustrated embodiment, the rotation occurs when the floor nozzle 12 contacts a wall or large object. The left and right nozzles are biased into an extended position by arms 216 of a spring 217 which cooperate with a retainer plate 218. A left guide post 220 and a right guide post (not visible) are provided for alignment and limitation of the nozzles during rotation.

Figure 13:
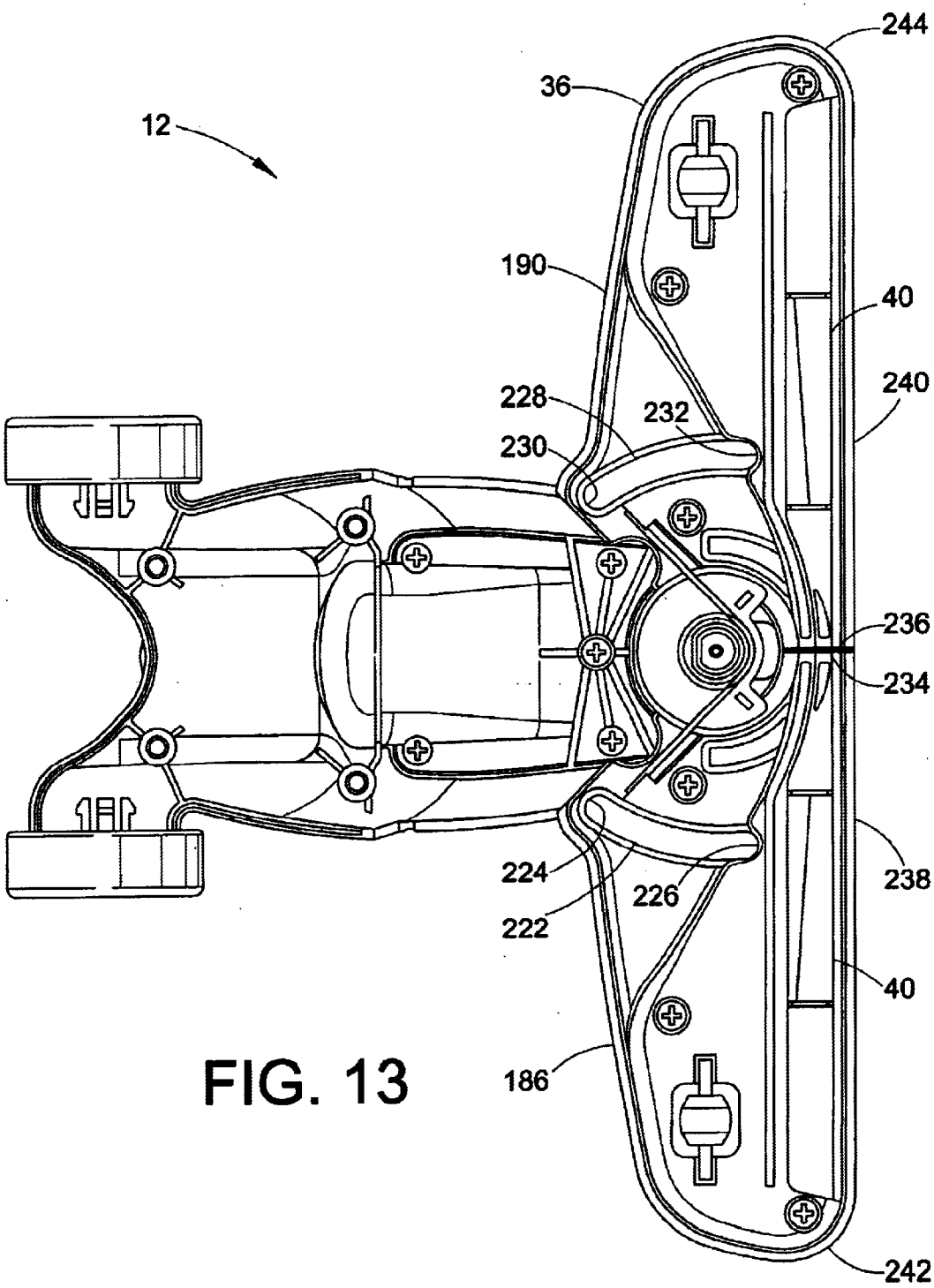
FIG. 13 is a bottom plan view of the floor nozzle of FIG. 1 in a fully extended position with a base plate removed.

With reference to FIG. 13, a slot 222 having a first end 224 and a second end 226 is defined in the left nozzle lower plate 186. A slot 228 having a first end 230 and a second end 232 is defined in the right nozzle lower plate 190. The guide posts 220 (referring back to FIG. 12) engage slots 222 and 224 to provide alignment and a limit of rotation for each nozzle head when pivoting.

The left nozzle 184, 186 reaches its extended position when the left guide post 220 contacts the wall of the first end 224 of the slot 222. The left nozzle 184, 186 reaches its retracted position when the left guide post 220 contacts the wall of the second end 226 of the slot 222. The right nozzle 188, 190 reaches its extended position when the right guide post contacts the wall of the first end 230 of the slot 228. The right nozzle reaches its retracted position when the right guide post contacts the wall of the second end 232 of the slot 228.

When both the left nozzle 184, 186 and the right nozzle 188, 190 are in the extended position, as shown, a front mating face 234 of the left nozzle 184, 186 and a front mating face 236 of the right nozzle 188, 190 are proximate and parallel to one another. The left nozzle 184, 186 includes a leading edge 238 and the right nozzle 188, 190 includes a leading edge 240. The leading edges 238 and 240 are linearly aligned when both the left nozzle 184, 186 and the right nozzle 188, 190 are in an extended position. Each of the left and right nozzles includes a distal edge 242 and 244, respectively.

Because of the bias urging the left and right nozzles in their extended positions, a user may maximize the area to be cleaned. However, when a large object or wall(s) is (are) encountered, one or both of the nozzle heads 184, 186 and 188, 190 may be caused to rotate by a leading edge 238 and 240 or distal edge 242 and 244 contacting the object or wall(s). The nozzle 12 and the object or wall is protected by the bumper 36.

Figure 14:
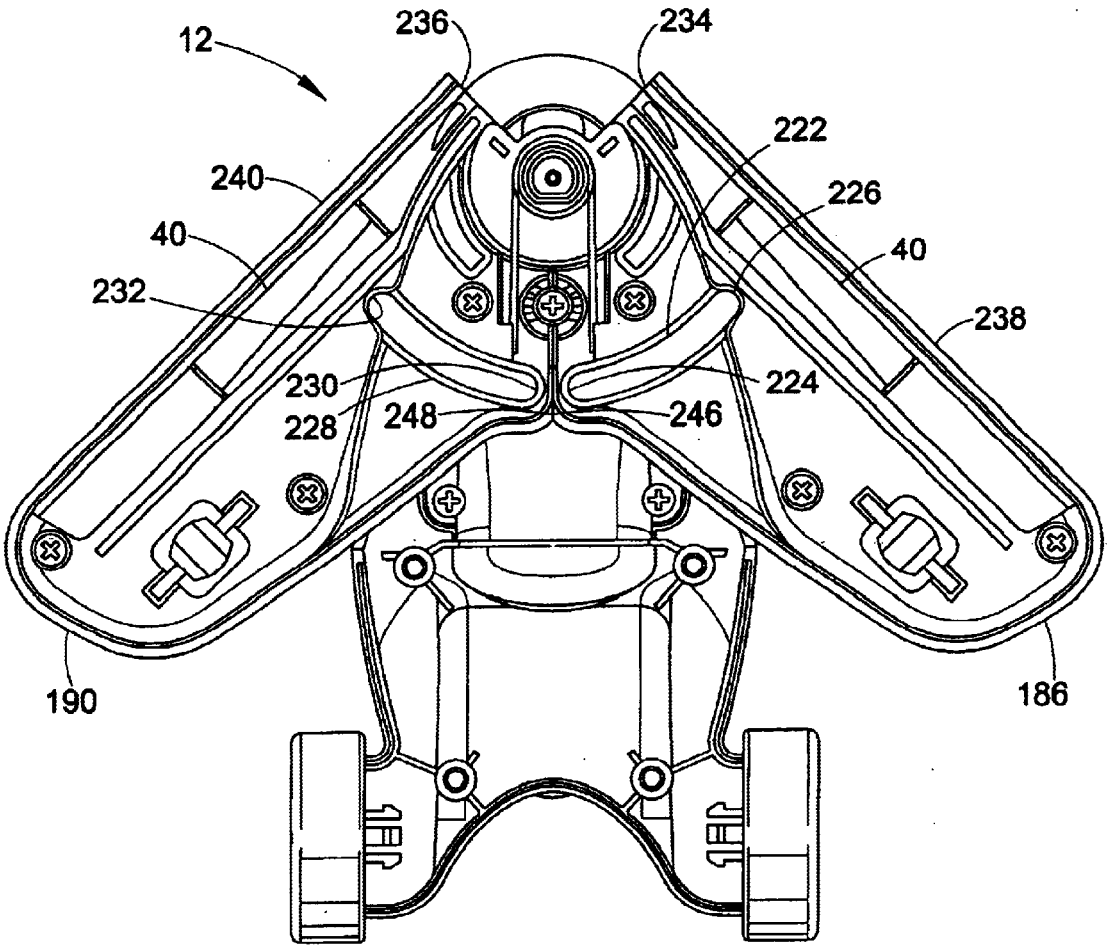
FIG. 14 is a bottom plan view of the floor nozzle of FIG. 1 in a fully retracted position with the base plate removed.

Turning now to FIG. 14, the nozzle halves are shown in a fully retracted position. This position may be encountered when a user is cleaning in a corner. In this position, the spring arms 216 are brought close to one another.

The left nozzle head 184, 186 and the right nozzle head 188, 190 may pivot independently, or, they may be linked together to pivot simultaneously. The nozzles may pivot from the extended position to the fully retracted position or any point in between. As described above, the guide posts 220 (referring back to FIG. 12) cooperate with the slots 222 and 228 to maintain alignment of the nozzles during rotation and to provide limits of rotation When both the left nozzle 184, 186 and the right nozzle 188, 190 are fully retracted at the same time, a rear mating face 246 of the left nozzle 184, 186 and a rear mating face 248 of the right nozzle 188, 190 are proximate and generally parallel, while the front mating faces 234 and 236 are approximately normal to one another.

With the split head configuration of the nozzle 12, hard-to-reach areas can easily be cleaned. In addition, when the floor nozzle 12 is no longer in contact with a large object or wall(s), the spring bias causes the left nozzle 184, 186 and the right nozzle 188, 190 nozzle to return to the extended position.

Although the nozzle 12 has been described with reference to a stick vacuum, it may be used on any type of vacuum cleaner, such as an upright cleaner, a canister vacuum cleaner and a hand-held cleaner that employs a wide nozzle. In addition, the exemplary embodiment has been illustrated as including left and right nozzle heads, i.e., two nozzle heads that pivot about a vertical axis. Other embodiments are anticipated by the present invention, such as a central housing with one nozzle that pivots about a vertical axis or a nozzle having three or more parts that pivot about a vertical axis.

The invention has been described with reference to a preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the invention, I claim:

1. An upright vacuum cleaner, comprising:

a floor nozzle having a suction inlet;

a handle;

a housing having a first portion connected to said floor nozzle and a second portion connected to said handle, the housing defining a cavity and at least one chamber;

a dirt cup assembly releasably connected to said housing and at least partially received by said cavity, said dirt cup assembly defining a cyclonic airflow chamber and including a wall;

an inlet duct defined on said dirt cup assembly wall;

a filter assembly removably positioned in said dirt cup assembly, wherein said filter assembly includes a top wall which cooperates with at least one wall of said dirt cup assembly to seal at least a portion of said cyclonic airflow chamber; and a motor assembly diposed in said at least one chamber defined by said housing.

2. The upright vacuum cleaner of claim 1, wherein said filter assembly comprises a filter cage and a filter media mounted on said filter cage.

3. The upright vacuum cleaner of claim 1, wherein said filter assembly is concentrically positioned in said dirt cup assembly.

4. The upright vacuum cleaner of claim 3, wherein said dirt cup assembly comprises a support connected to a base wall, and wherein said filter assembly is mounted on said support.

5. The upright vacuum cleaner of claim 1, further comprising a latch assembly for selectively securing said dirt cup assembly to said housing.

6. The upright vacuum cleaner of claim 1, further comprising a ducting system located within said floor nozzle and said housing for fluidically connecting said suction inlet to said dirt cup inlet duct, whereby air is drawn in through said suction inlet, through said dirt cup inlet duct and cyclonically filtered in said dirt cup assembly and expelled through an opening in said dirt cup assembly.

7. The upright vacuum cleaner of claim 1 wherein said filter assembly top wall comprises a handle.

8. A stick vacuum cleaner, comprising:

a floor nozzle having a suction inlet;

a housing connected to said floor nozzle, the housing having a front panel and a rear panel, said housing including a cavity and at least one chamber spaced therefrom;

said front panel of said housing defining a first aperture that opens into said cavity;

said rear panel of said housing defining a second aperture that opens into said cavity, wherein said second aperture is smaller than said first aperture;

a dirt cup releasably mounted to said housing and at least partially received in said cavity, wherein the dirt cup extends into said first aperture and into said second aperture when mounted on said housing, said dirt cup being removable from said housing in a frontal direction; and a motor assembly disposed in said at least one chamber defined by said housing.

9. The stick vacuum cleaner of claim 8, wherein said dirt cup comprises:

a front wall;

a rear wall;

a first side wall extending between said front and rear walls;

a second side wall extending between said front and rear walls;

a pair of wings extending respectively past said first and said second side walls adjacent said front wall, whereby at least a portion of said front wall remains substantially flush with said front portion of said housing when said dirt cup is mounted on said housing in a use position.

10. The stick vacuum cleaner of claim 8, wherein said dirt cup rear wall defines a contoured portion; and said housing second aperture cooperates with said contoured portion of said dirt cup when the dirt cup is mounted on said housing in a use position.

11. The stick vacuum cleaner of claim 8, wherein said dirt cup comprises a tangential inlet so that said dirt cup defines a cyclonic airflow chamber.

12. The stick vacuum cleaner of claim 11, further comprising a removable filter assembly positioned in said cyclonic airflow chamber.

13. The stick vacuum cleaner of claim 8, further comprising a latch assembly for selectively securing said dirt cup to said housing.

14. A stick vacuum cleaner, comprising:

a floor nozzle having a suction inlet;

a main handle;

a housing having a first portion connected to said floor nozzle and a second portion connected to said main handle, the housing defining a cavity and at least one chamber;

a dirt cup releasably connected to said housing and at least partially received by said cavity, wherein the dirt cup is movable in relation to said housing from a use position to an emptying position;

a filter assembly located in said dirt cup;

a lid selectively closing an open upper end of said dirt cup;

a handle located on said lid; and a motor assembly disposed in said at least one chamber defined by said housing.

15. The stick vacuum cleaner of claim 14, wherein said filter assembly comprises a primary filter and further comprising a secondary filter mounted in said housing between said dirt cup and said motor assembly.

16. The stick vacuum cleaner of claim 14 further comprising a dirt cup handle connected to said dirt cup assembly and spaced from said main handle, wherein the stick vacuum cleaner may be lifted by the dirt cup handle when the dirt cup is in the use position.

17. The stick vacuum cleaner of claim 14 wherein said lid is connected to said filter assembly.

18. The stick vacuum cleaner of claim 14 wherein said dirt cup includes a tangential inlet so that said dirt cup defines at least part of a cyclonic airflow chamber.

19. The stick vacuum cleaner of claim 14 wherein said dirt cup includes a base that defines an exhaust duct, and wherein said filter assembly and said exhaust duct are aligned with each other.

20. The stick vacuum cleaner, comprising:

a floor nozzle having a suction inlet;

a housing connected to said floor nozzle;

a dirt cup assembly releasably connected to said housing;

said dirt cup assembly including a base and walls which cooperate to define a cavity;

an inlet duct located on one of said base and walls of said dirt cup assembly;

a filter support element mounted on one of said base and walls of said dirt cup assembly;

a filter selectively mounted on said filter support element;

a motor mounted to said housing; and a secondary filter, wherein said secondary filter is mounted in said housing between said dirt cup assembly and said motor.

21. The stick vacuum cleaner of claim 20, wherein said filter support element is an integrally molded component of said dirt cup base.

22. The stick vacuum cleaner of claim 20, wherein said filter suppport element is an independent component connected to said dirt cup base.

23. The stick vacuum cleaner of claim 20, wherein said dirt cup base defines an exhaust duct, and wherein said filter support element surrounds said exhaust duct and extends into said cavity.

24. The stick vacuum cleaner of claim 23 wherein said exhaust duct and an inlet of said motor are align along a longitudinal axis.

25. The stick vacuum cleaner of claim 20, wherein said filter comprises a filter cage and a bottom support connected to a distal end of said filter cage, and wherein said bottom support cooperates with said filter support element to selectively mount said filter to said dirt cup assembly.

26. The stick vacuum cleaner of claim 25, wherein at least one of said bottom support and said filter support element includes a sealing member, whereby a seal is formed between said bottom support and said filter support element by said sealing member.

27. A stick vacuum cleaner, comprising:

a floor nozzle having a suction inlet;

a housing connected to said floor nozzle, the housing defining a cavity and at least one chamber;

a dirt cup assembly releasably connected to said housing and at least partially received by said housing cavity, wherein said dirt cup assembly includes a front wall, a rear wall, a first side wall, a second side wall and a base wall, said walls being interconnected to define a dirt cup cavity;

a filter assembly mounted in said dirt cup cavity, said filter assembly including a top wall;

a gasket extending away from an upper surface of said filter assembly top wall;

a skirt extending away from a lower surface of said filter assembly top wall in a manner offset from said gasket, wherein at least one of said walls of said dirt cup assembly includes an upper portion having a projection, and wherein said filter assembly top wall, said gasket and said skirt cooperate with said dirt cup wall projection to form a labyrinth seal; and a motor assembly disposed in said at least one chamber defined by said housing.

28. The stick vacuum cleaner of claim 27, wherein said labyrinth seal encloses at least a portion of said dirt cup cavity.

29. The stick vacuum cleaner of claim 27, wherein the filter assembly is removably mounted in said dirt cup cavity.

30. The stick vacuum cleaner of claim 27, wherein said filter assembly is concentrically positioned in said dirt cup cavity.

31. The stick vacuum cleaner of claim 27, wherein said dirt cup base wall defines an exhaust duct, and wherein said filter assembly and said exhaust duct are aligned.

32. An upright vacuum cleaner, comprising:

a housing comprising a floor nozzle and defining a first cavity and at least on chamber;

a dirt cup releasably connected to said housing and at least partially received in said first cavity, said dirt cup defining a second cavity;

said dirt cup including a conversion port for above-the-floor cleaning; and a motor assembly disposed in said at least one chamber defined by said housing.

33. The upright vacuum cleaner of claim 32, wherein said dirt cup includes an inlet duct and said conversion port is defined in said inlet duct.

34. The upright vacuum cleaner of claim 33, wherein said inlet duct is located on a front wall of said dirt cup.

35. The upright vacuum cleaner of claim 32, wherein said conversion port is defined in a rear wall of said dirt cup.

36. The upright vacuum cleaner of claim 32, wherein said dirt cup includes a tangential inlet so that said second cavity functions as a cyclonic airflow chamber.

37. The upright vacuum cleaner of claim 32, further comprising:

a hose including a conversion adapter having a distal end;

said conversion adapter engaging said conversion port in an above-the-floor cleaning mode, whereby the distal end of said adapter is in fluid communication with said second cavity.

38. The upright vacuum cleaner of claim 37, wherein said adapter includes a shoulder having a larger circumference than is a circumference of an orifice defined by said conversion port.

39. The upright vacuum cleaner of claim 37, further comprising a door disposed on said conversion port, whereby in a floor cleaning mode said door substantially seals an orifice defined by said conversion port.

40. The upright vacuum cleaner of claim 39, wherein said door is pivotable about a hinge.

41. A stick vacuum cleaner, comprising:

a floor nozzle having a suction inlet;

a handle assembly pivotally mounted on said floor nozzle, said handle assembly comprising:

a first portion defining a motor chamber, a motor assembly located in said motor chamber, and a second portion defining a socket, a dirt cup selectively positioned in said socket, said dirt cup including an inlet to a dirt separation chamber, at least partially defined in said dirt cup, and an outlet from said dirt separation chamber, said outlet communicating with said motor assembly; and a conversion port defined in a wall of said dirt cup for above-the-floor cleaning.

42. The stick vacuum cleaner of claim 41 further comprising a filter selectively located in said dirt cup, wherein said filter is spaced from said conversion port.

43. The stick vacuum cleaner of claim 42 wherein said dirt cup further comprises a stem extending into said dirt separation chamber, said stem defining said dirt cup outlet, wherein said filter surrounds said stem.

44. The stick vacuum cleaner of claim 41 wherein said conversion port is located on a front wall of said dirt cup.

45. The stick vacuum cleaner of claim 41 wherein said conversion port is located on a rear wall of said dirt cup.

* * * * *